US006224294B1

(12) United States Patent
Mansfield

(10) Patent No.: US 6,224,294 B1
(45) Date of Patent: May 1, 2001

(54) TUBULAR PILING DRIVING APPARATUS AND PILING INSTALLATION METHOD

(76) Inventor: Peter W. Mansfield, P.O. Box 338, Urbanna, VA (US) 23175-0338

( * ) Notice: Subject to any disclaimer, the term of this patent is extended or adjusted under 35 U.S.C. 154(b) by 0 days.

(21) Appl. No.: 09/370,407

(22) Filed: Aug. 9, 1999

Related U.S. Application Data

(63) Continuation-in-part of application No. 09/112,490, filed on Jul. 9, 1998, now Pat. No. 5,934,826.

(51) Int. Cl.[7] ..... E02D 7/08; E02D 7/10

(52) U.S. Cl. ..... 405/232; 405/228; 173/1; 173/127

(58) Field of Search ..... 405/231, 232, 405/249, 245, 228; 173/1, 112–115, 125–128, 132, 200, 89, 152, 135, 206; 175/135

(56) References Cited

U.S. PATENT DOCUMENTS 3,526,283 * 9/1970 Horstketter et al. ..... 173/126
3,714,789 * 2/1973 Chelminski ..... 405/232
3,721,095 * 3/1973 Chelminski ..... 405/232
3,847,230 * 11/1974 Blomquist ..... 173/127
4,126,191 * 11/1978 Gendron et al. ..... 173/1
4,238,166 * 12/1980 Gendron ..... 405/228

* cited by examiner

*Primary Examiner*—David Bagnell
*Assistant Examiner*—Sunil Singh
(74) *Attorney, Agent, or Firm*—Charles J. Prescott

(57) ABSTRACT

A tubular piling driving apparatus and a method of securing a tubular piling into the bottom of a body of water using the apparatus. The apparatus is pressurized fluid-actuated, preferably pneumatic, and is positionable substantially within an upper end of a tubular piling to be secured into the bottom. The weight of the entire apparatus acts upon the upper end of the piling through a collar fitted onto the upper piling end. One or more additional weights are supported at the upper end of the axially movable shaft of the apparatus which increase both downward static and inertia forces transmitted through the collar to effect piling installation as the shaft repeatedly raises and drops the weights against the upper end of the tubular piling through the collar.

2 Claims, 11 Drawing Sheets

42
44
40
54
56
60
58
46
48
50
52

TUBULAR PILING DRIVING APPARATUS AND PILING INSTALLATION METHOD

This is a continuation-in-part of application Ser. No. 09/112,490 filed Jul. 9, 1998, now U.S. Pat. No. 5,934,826.

BACKGROUND OF THE INVENTION

1. Scope of Invention

This invention relates generally to pilings and boat lifts supported on pilings and docks and more particularly to a tubular piling driving apparatus and method of piling installation using the apparatus.

2. Prior Art

Pilings for supporting a dock and for providing a tie-off for boats are typically made of long wooden poles for economy. These long wooden poles or pilings may be treated in various ways to enhance the useful lifetime thereof. However, all such wooden pilings are subject to the deteriorating effects, especially salt water and brackish water which accelerate deterioration and result in heavy growth below the waterline.

Steel and concrete have been used as substitutes for the less expensive wooden piling structure, but also have significant rapid deterioration characteristics, again, especially in salt and brackish waters. Additionally, wooden pilings are also subject to upper exposed end deterioration from wildlife and weather conditions which accelerate deterioration.

All stationary boat support and boat lift apparatus require attachment and support from a piling or dock attached to the pilings. Typically, boat support apparatus include a boat cradle of some sort which may be cantilevered or supported at each end by cable, chain or rod structure associated with a motor and drive train structure for vertically positioning the boat cradle with a boat supported thereby. If such boat lift apparatus are simply attached to the exterior of a piling or dock, rapid deterioration from sun and weather conditions, again salty conditions being the worst, will reduce the useful life of these apparatus and/or certainly result in cosmetic deterioration.

The present invention discloses utilization of an inert type material such as polyvinyl chloride (pvc) plastic as the primary piling structure filled in part with concrete for reinforcement. The method of embedding the lower end portion of the hollow tubular piling into the bottom of the water is provided, along with a compact and fully concealed motor and drive train structure. The present invention further discloses a method of driving tubular pilings with a small compact self-contained pneumatic driving apparatus that can be placed in position for driving a tubular piling by one man without the need for large pole driving barges and associated equipment.

BRIEF SUMMARY OF THE INVENTION

This invention is directed to a tubular piling driving apparatus and method of securing a tubular piling into the bottom of a body of water. The apparatus is pressurized fluid-actuated, preferably pneumatic, and is positionable substantially within an upper end of a tubular piling to be secured into the bottom. The weight of the entire apparatus acts upon the upper end of the piling through a collar. One or more additional weights are supported at the upper end of the axially movable shaft of the apparatus which increase both downward static and inertia forces transmitted through the collar to effect piling installation as the shaft repeatedly raises and drops the weights against the upper end of the tubular piling via the collar.

It is therefore an object of this invention to provide a tubular piling installation arrangement and method of securing the pilings into the bottom of a body of water.

It is still another object of this invention to provide a method of embedding the tubular piling structure into the bottom of a body of water using the piling driving apparatus.

It is still another object of this invention to provide a substantially inert piling structure which is unaffected by weathering conditions and the deteriorating effect of both fresh and salt water environments.

It is yet another object of this invention to provide a combination boat lift apparatus and tubular piling structure which houses the motor and drive train components within the upper portion of the enclosed hollow tubular piling structure.

In accordance with these and other objects which will become apparent hereinafter, the instant invention will now be described with reference to the accompanying drawings.

DETAILED DESCRIPTION OF THE INVENTION

Figure 1:
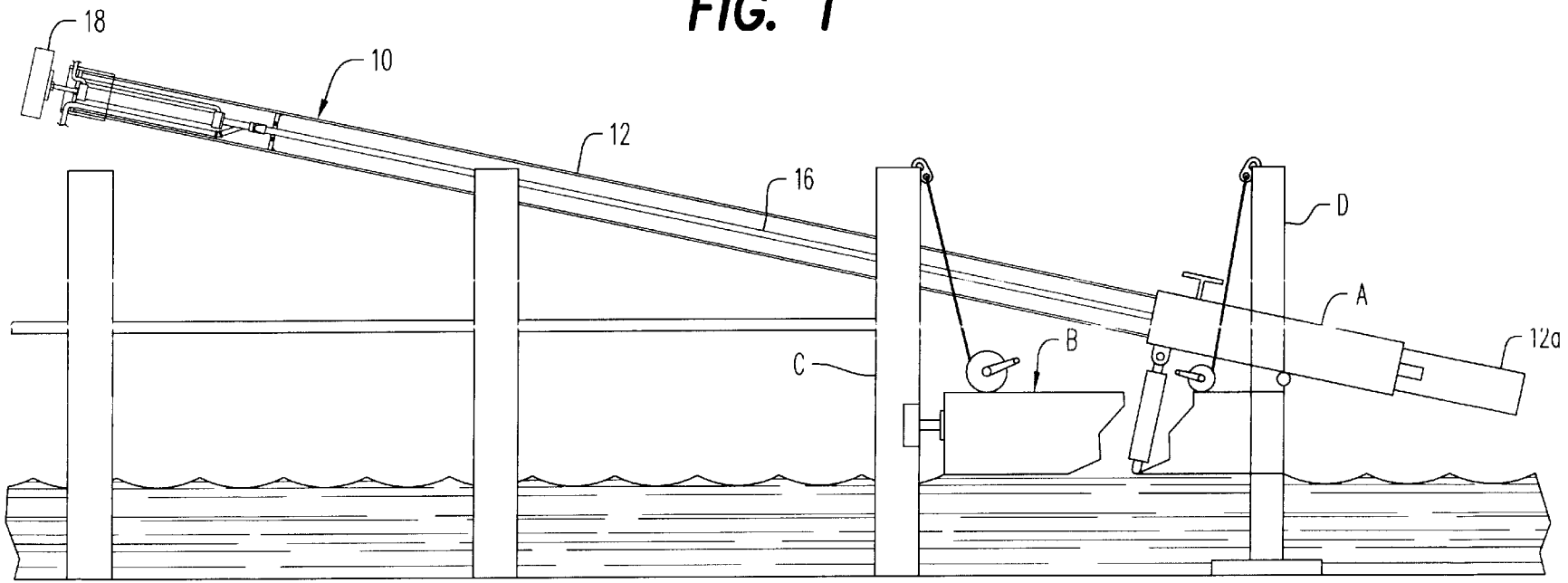
FIG. 1 is a side elevation schematic view depicting the beginning of the process of securing a tubular piling member into the bottom of a body of water according to the teachings of this invention.
Figure 2:
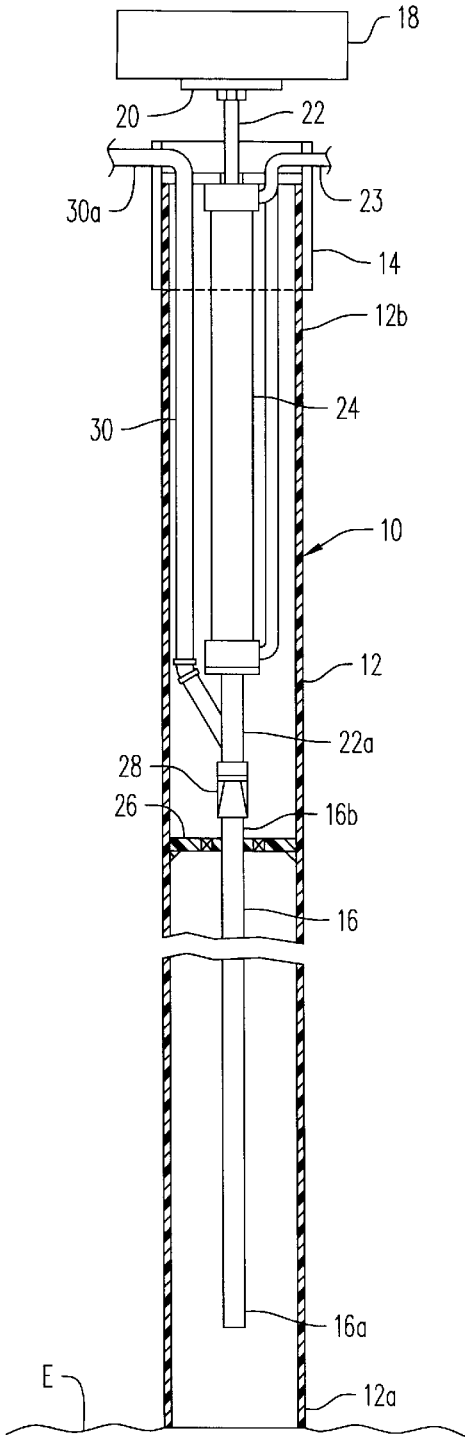
FIG. 2 is a side elevation simplified schematic section view of the tubular piling and associated equipment for embedding the piling into the bottom of a body of water.
Figure 3:
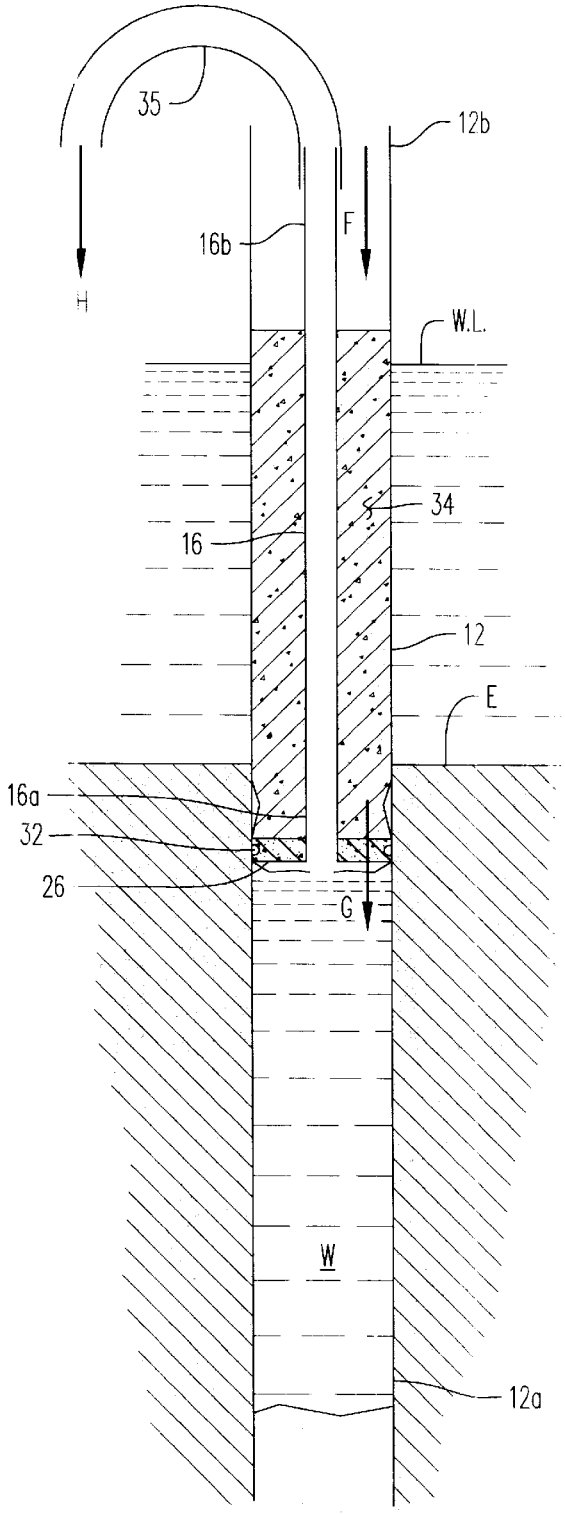
FIG. 3 is a side elevation schematic view of the process of filling the lower portion of the tubular piling with concrete after the lower end thereof has been evacuated of soil and debris from the bottom of the water utilizing the equipment shown in FIG. 2, now removed.

Referring now to the drawings and particularly to FIGS. 1 to 3, the steps of the method of deploying a tubular piling according to the invention into the bottom of a body of water are there shown. In FIG. 1, the apparatus 10 is shown being moved into an upright orientation through the use of a floating barge B. Existing pilings shown typically at C are used to stabilize the barge B, along with outriggers shown typically at D. The barge B includes a hydraulically tiltable sleeve A into which an outer tubular member 12 formed of pvc plastic pipe or tubing is positioned. The lower end portion 12*a* of the outer tubular member 12 will come to rest against the bottom of the body of water with the apparatus in an upright orientation as seen in FIG. 2.

After the apparatus 10 is in an upright orientation against the bottom E, an optional water jet stream is directed into inlet 30*a,* through conduit 30 and coupling 28 for downward discharge through a jet pipe 16. The jet pipe 16 is supported through a water jet alignment guide plate 26 at the upper end 16*b* of the jet pipe 16. Care must be taken not to blow around and out of the pvc pipe 12.

Figure 10:
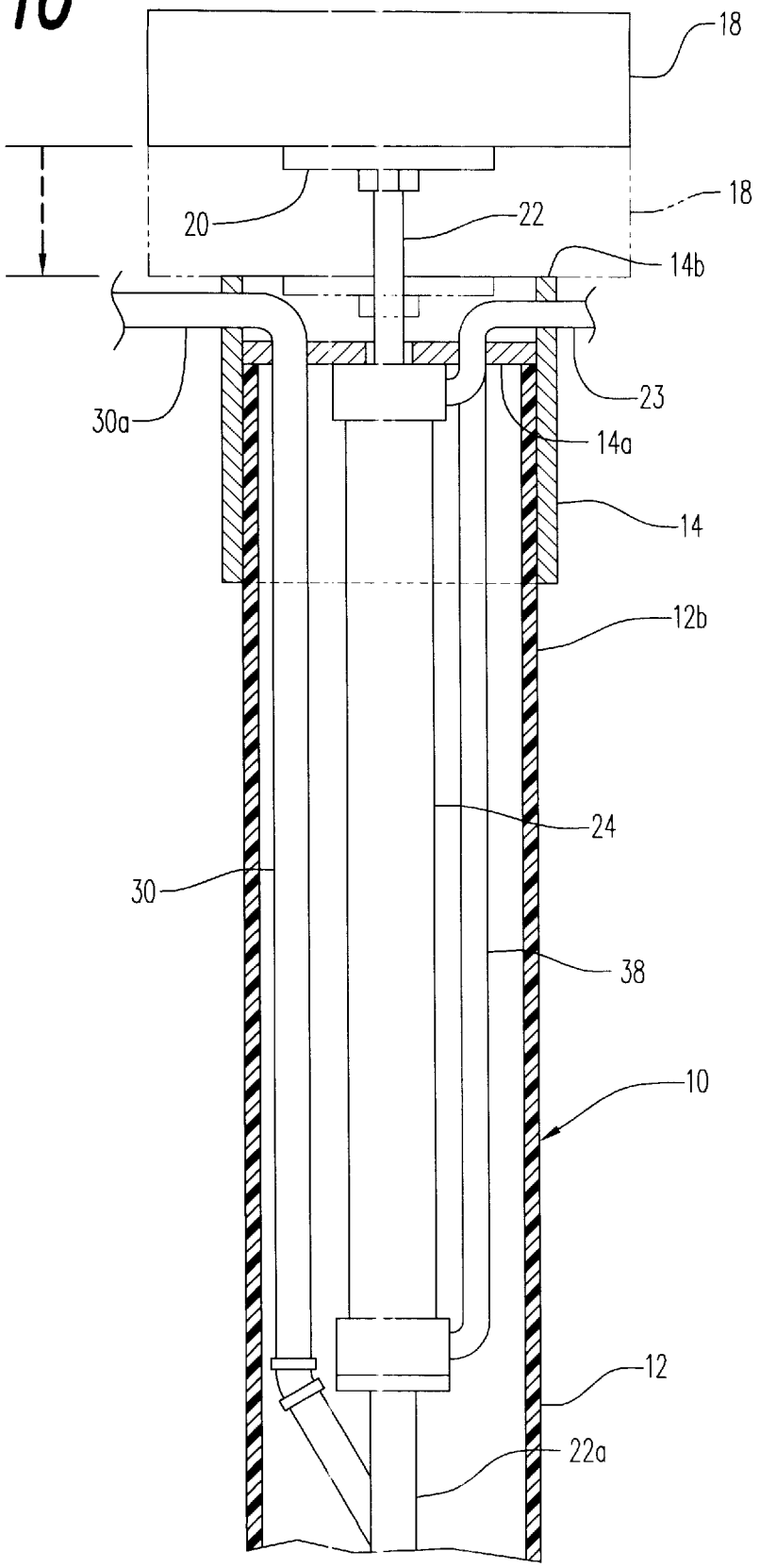
FIG. 10 is an enlargement of the upper portion of FIG. 2 more clearly showing the tubular piling driving apparatus schematically.
Figure 11:
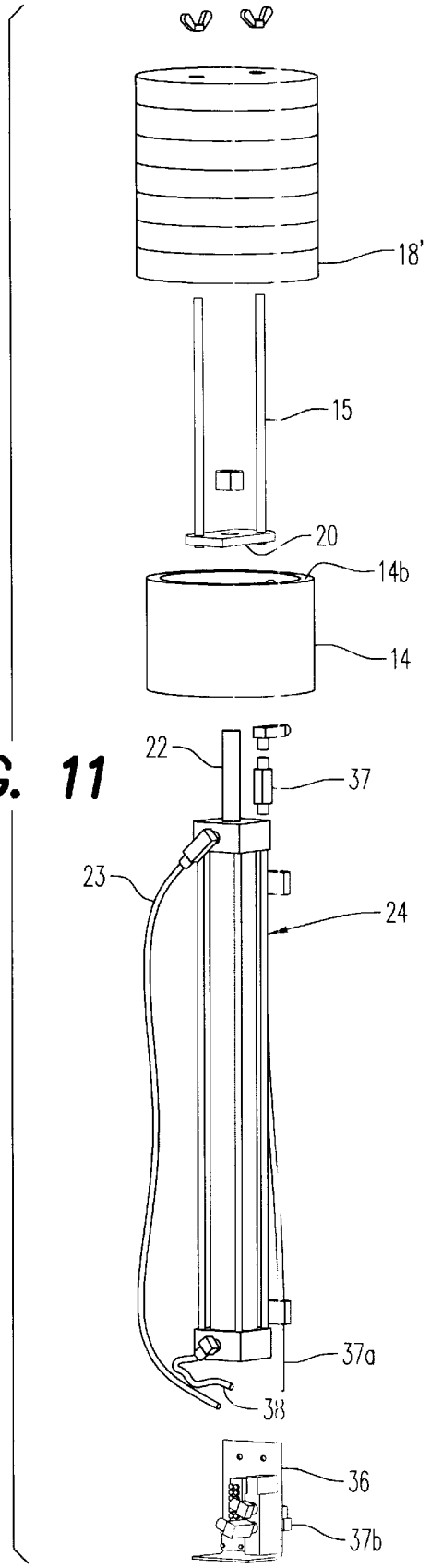
FIG. 11 is an exploded side elevation view of the tubular piling driving apparatus shown in FIGS. 2 and 10.
Figure 12:
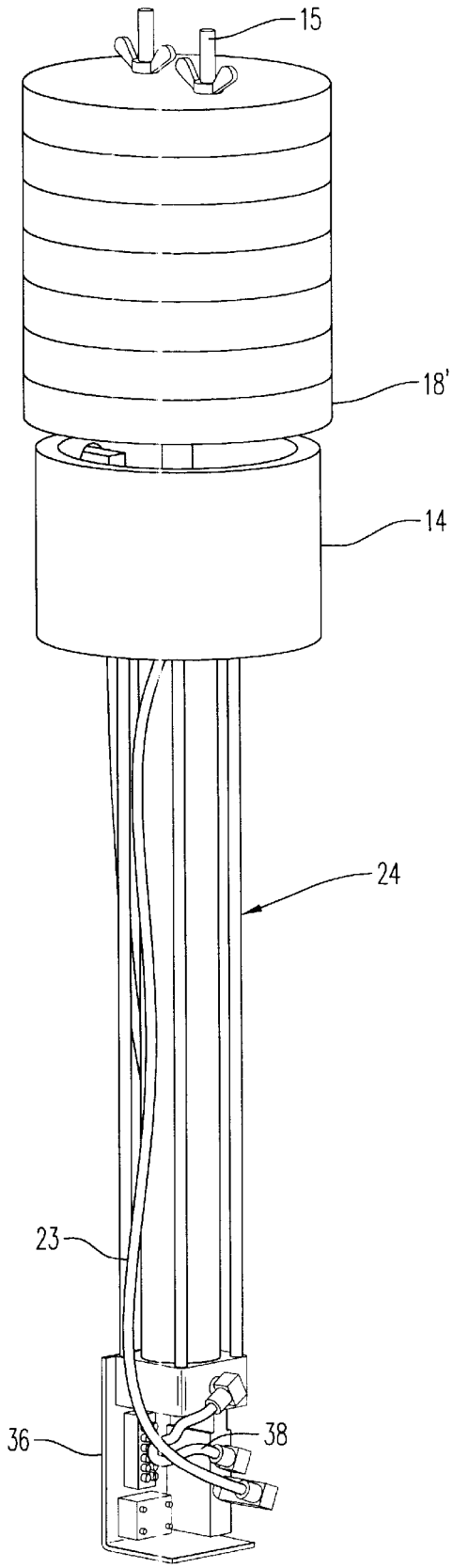
FIG. 12 is an assembled view of the tubular piling driving apparatus of FIG. 11.

Although the water jet arrangement above described is sufficient to dislodge the bottom material from below and within the outer tubular member 12 so as to implant or submerge the lower end portion 12*a* into the bottom E as shown in FIG. 3, referring additionally to FIGS. 10 to 12, a separate impact or piling driving apparatus shown generally at numeral 24 is also provided. This apparatus 24 includes a collar 14 and a disc shaped apertured plate 14*a* thereof sized to engage and rest atop the upper end of the outer tubular conduit 12. A heavy weight 18 or multiple weights 18' in FIGS. 11 and 12, is supported atop a level block 20 which is connected to an upright shaft 22 of the apparatus 24 which includes an air impact cylinder. Elongated rods 15 hold the multiple weights 18' together and against block 20. By pressurizing the apparatus 24 at the inlet fitting 37, pressurized fluid is repeatedly delivered via a manifold 36 through the interconnection between 37*a* and 37*b* to the lower end of the apparatus through conduit 38 causing the weight 18 or 18' to rise to the full extent of shaft 22. Pressurized fluid is then alternately switched to conduit 23 which, along with the gravitational fall of weight 18 or 18', helps to drive the rod 22 down, thereby adding to the downward impact against the upper end 14*b* of collar 14. By this arrangement, air impulses through inlet tube 23, combined with the heavy weight 18, will quickly drive the lower end portion 12*a* of the outer tubular member 12 into the water bottom E a distant sufficient for proper supportive stabilization thereby. Although the above-described water jet arrangement may assist in this effort, the apparatus 24 is self-sufficient for this purpose.

In FIG. 3, after substantially all of the bottom material has been evacuated from within the lower portion 12*a* of the tubular conduit 12 using a commercially available pump and the air impact cylinder 24 and water jet equipment having been removed, a concrete disc 26 complete with an o-ring 32 and evacuation tube 16, are pushed down the pvc pipe 12, which displaces the water up the evacuation tube 16 to discharge tube 35, leaving a dry hollow pipe 12. A quantity of uncured concrete or other heavy curable material shown at 34 is poured into the upper open end portion 12*b* in the direction of arrow F. The weight of this uncured concrete 34 is such that the concrete disc 26 will be forced downwardly in the direction of arrow G in sliding sealed fashion within the inner wall surface of the outer tubular member 12. Any water W still present within the lower portion 12*a* is also evacuated upwardly within the evacuation tube 16 for discharge in the direction of arrow H from a flexible discharge hose 35. By this arrangement, virtually all of the water W is evacuated and replaced with curable concrete 34 which adds strength and integrity to the entire submerged portion of the outer tubular member 12 once the concrete 34 is properly cured. The concrete disc 26 and evacuation tube 16 are permanently left at the bottom of the concrete near the lower end of outer tubular member 12. If it is desired to later remove this piling, a lifting force will be developed by pressurizing the evacuation tube 16.

Figure 4:
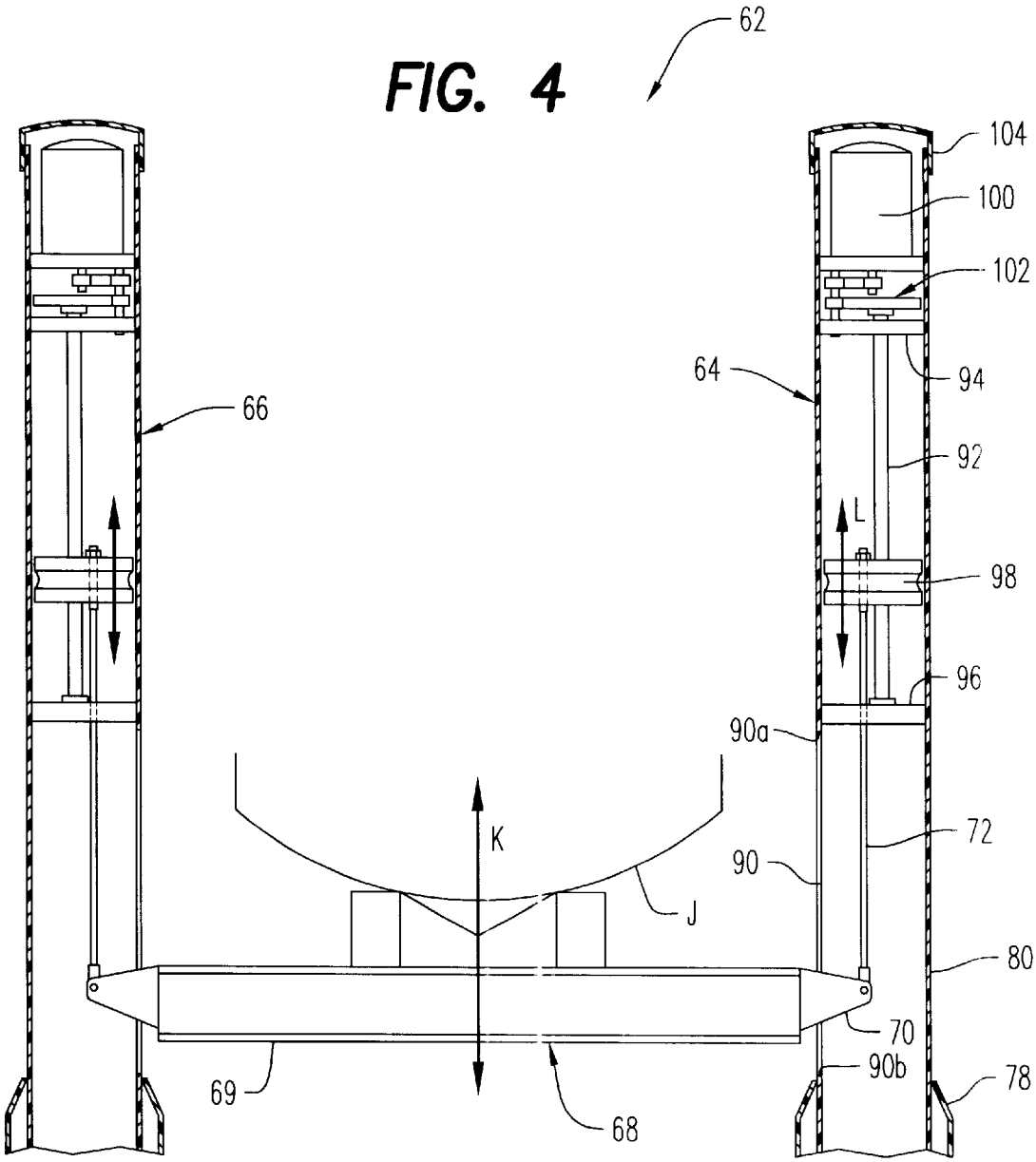
FIG. 4 is a simplified side elevation section view of one embodiment of the invention.

Referring now to FIG. 4, one embodiment of a combination boat lift apparatus and tubular piling structure is there shown generally at numeral 62. This combination 62 includes a boat lift 68 comprised of an elongated horizontally extending support cradle 69 for securely supporting the hull J of a boat and end plates 70. The intended movement of the boat cradle 68 is vertically in either direction in the direction of arrow K with respect to the water line WL as desired.

Each of the pilings 64 and 66 are embedded into the bottom of the water (not shown in FIG. 4) as previously described and support each respective end plate 70 of the boat cradle 68. For simplicity, the tubular piling 64 will be described, piling 66 being identical thereto. Tubular piling 64 includes an elongated pvc plastic tubular member 80 which defines the exposed above water portion of the piling 64 and the larger diameter tubular member 12 connected to tubular member 80 by a reducer 76 as better described with respect to FIG. 5 herebelow. A drive motor 100 is mounted adjacent the upper end of tubular member 80 below which a conventional gear train arrangement 102 is supported on fixed transverse plate 94. An ACME-type screw drive member 92 downwardly extends from the drive train 102 and is supported at its lower end by a fixed support plate 96 and associated support bearing. The rotatable drive shaft 92 moves a moveable plate 98 which preferably provides an electrical insulator between drive shaft 92 and tension cable 72, by threaded engagement up and down in the direction of arrow L in response to motor 100 activation. An upper removable sealing cap 104 renders the entire upper hollow portion of tubular member 80 weather resistant.

A chain, cable or rod 72 rigidly connected at its upper end to the moveable plate 98 downwardly extends to support the end plate 70 of the boat cradle 68. An elongated longitudinally extending slot 90 is formed into the tubular member 80 which extends from 90*a* to 90*b*. This slot 90 provides the necessary sliding clearance of the end plate 70 to chain 72 to effect upward and downward movement in the direction of arrow K.

Figure 5:
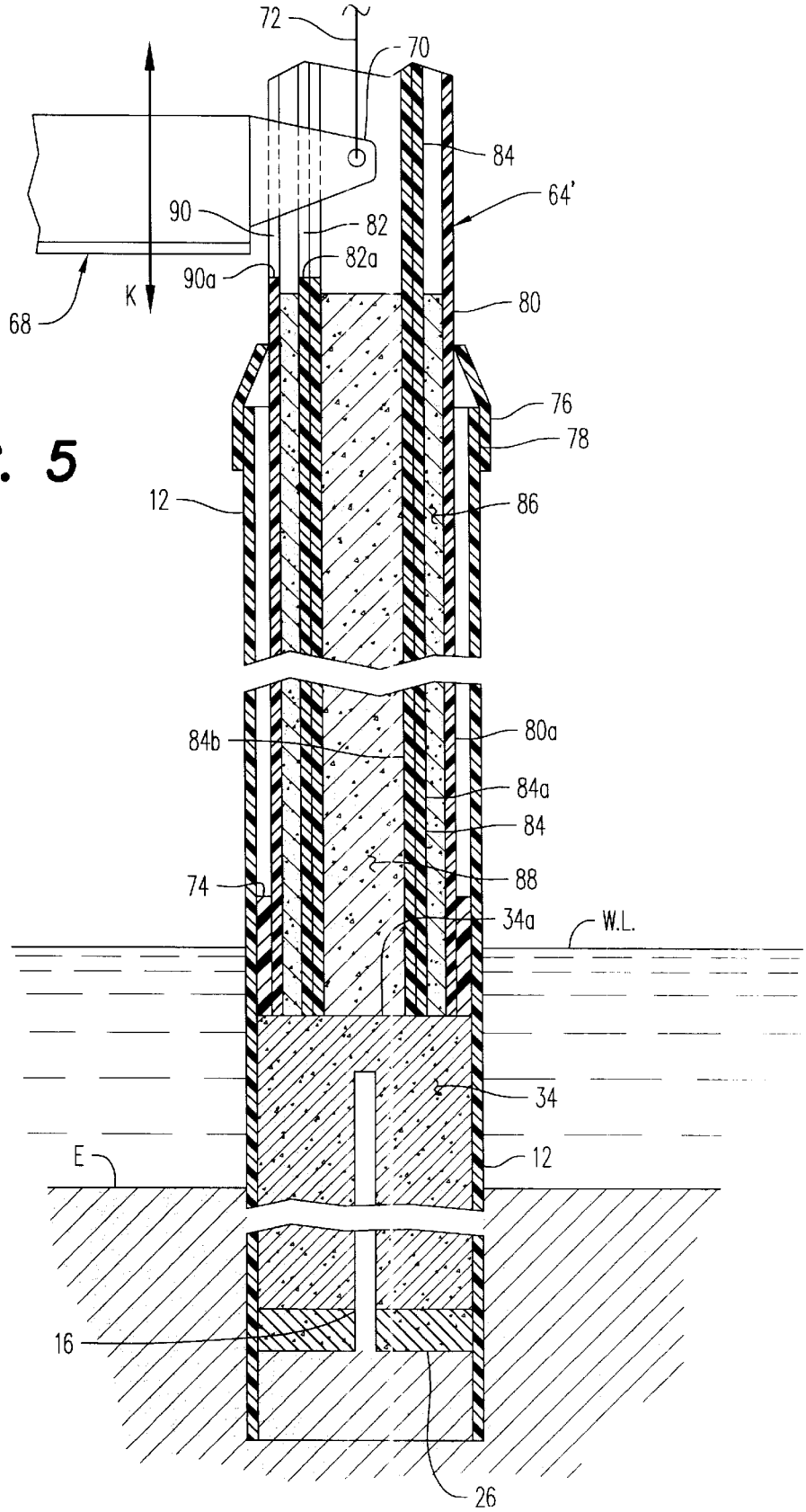
FIG. 5 is a side elevation section view of a portion of another embodiment of the invention.

Referring to FIG. 5, a lower portion of a modified piling 64' includes the larger diameter outer tubular (preferably 10") pvc plastic conduit 12 which has been embedded into the bottom E as previously described. A pvc bell-shaped reducer 76 provides stabilizing and concentric aligning attachment between the tubular member 80 and the outer tubular member 12. The reducer 76 is adhered to the upper end of the outer tubular member 12 only along circumferential surface 78. The lower end of tubular member 80 is rested atop the upper surface 34*a* of the cured concrete 34 as previously described. An annular alignment collar 74 insures tight and supportive concentric alignment of the lower end of tubular conduit 80.

In this piling apparatus 64' an additional reinforcing structure is also provided which defines an inner tubular member 84, the tubular member 80 becoming an intermediate tubular member at its lower portion 80*a*. The inner tubular member 84 is formed of two concentrically aligned closely mating pvc tubular members 84*a* and 84*b*. The tubular member 84*a* is slit lengthwise and spread apart to effect a close and secure wrapped alignment around tubular member 84*b,* the lower portion thereof filled with curable concrete at 88. The cylindrical void between the inner tubular member 84 and the intermediate tubular portion 80*a* is also filled with a curable concrete 86 for stabilization and added reinforcement against flexure forces produced by the weight of the boat atop the cradle 68.

Again, a longitudinal slot 90 is formed into the tubular member 80 as previously described which is aligned and registered and generally coextensive with a separate longitudinal slot 82 formed through the wall of the tubular member 84 so as to provide clearance access and ease of vertical movement in the direction of arrow K of the cradle 68 and its end blade 70.

Figure 6:
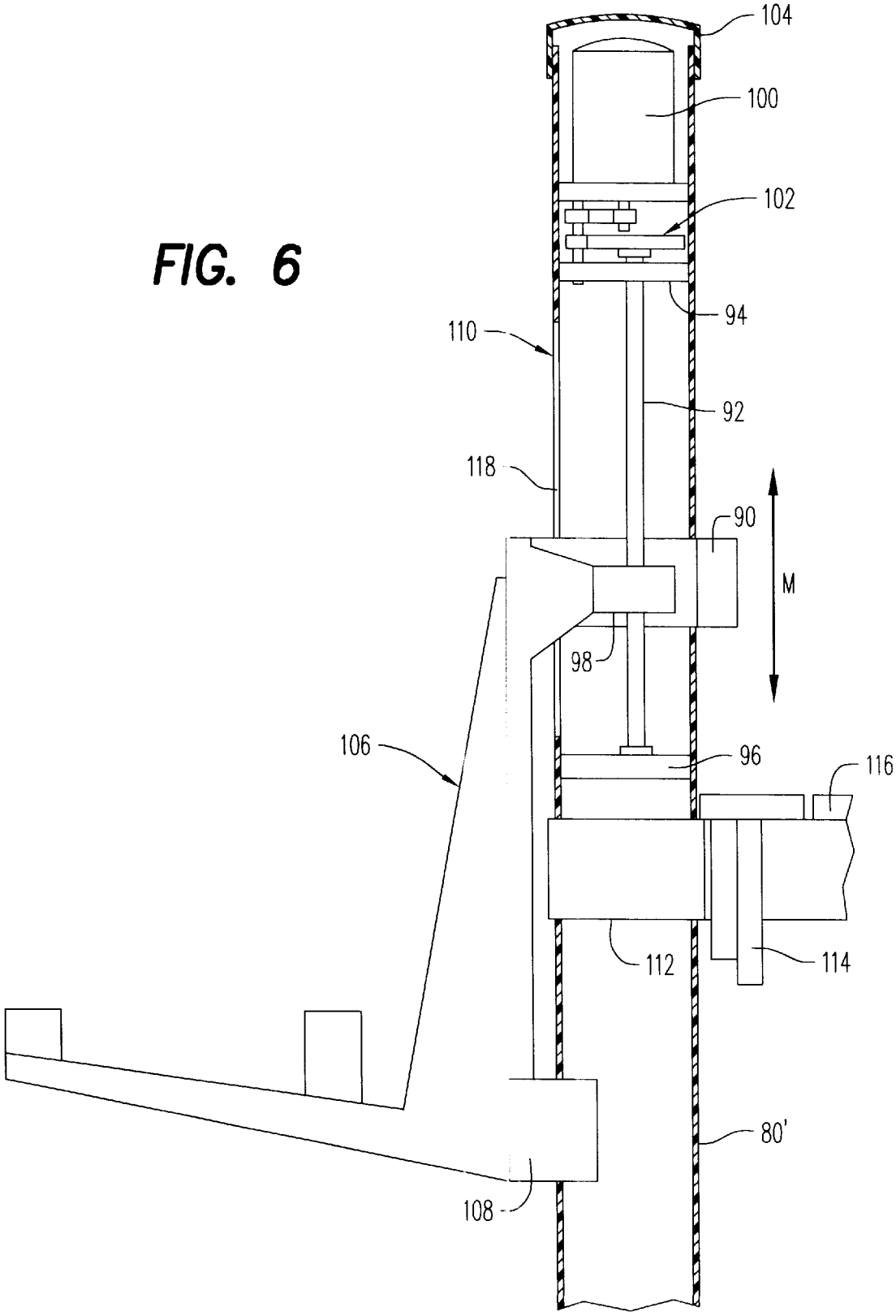
FIG. 6 is a side elevation view of an upper portion of still another embodiment of the invention attached to a dock structure.

Referring now to FIG. 6, another embodiment of the invention is generally shown at numeral 110 providing an outer tubular piling 80' formed of pvc plastic conduit as previously described. A boat cradle shown generally at numeral 106 in the form of a cantilevered boat lift is operably connected as herebelow described so as to move up and down in the vertical direction of arrow M.

A drive motor 100, gear train arrangement 102 and ACME screw drive shaft 92 are provided as previously described and mounted in the upper portion of the tubular member 80'. The drive shaft 92 is threadedly engaged through moveable support 98 which moves vertically in the direction of arrow M in response to rotational driving input of the drive shaft 92. A lower support plate 96 fixed within the tubular member 80' stabilizes and supports the lower end of drive shaft 92.

The boat lift 106 extends into the hollow interior of the tubular member 80' through upright longitudinally extending slot 118. Collar 90 slidably fitting around tubular member 80' helps to stabilize the boat lift 106 from undesired rotation about the vertical axis of the drive shaft 92. Additionally, saddle 108 extending part way around tubular member 80' further stabilizes the boat lift 106 from rotational and any side-to-side or swinging movement either at rest or when being vertically repositioned. The lower end portion of tubular member 80' is similar to that described in FIG. 3. One example of an interconnecting means between the piling 110 and a dock structure is also shown in the form of a collar 112 tightly secured around tubular member 80' which is interconnected to upright joists 114 supporting the dock planking 116.

Figure 7:
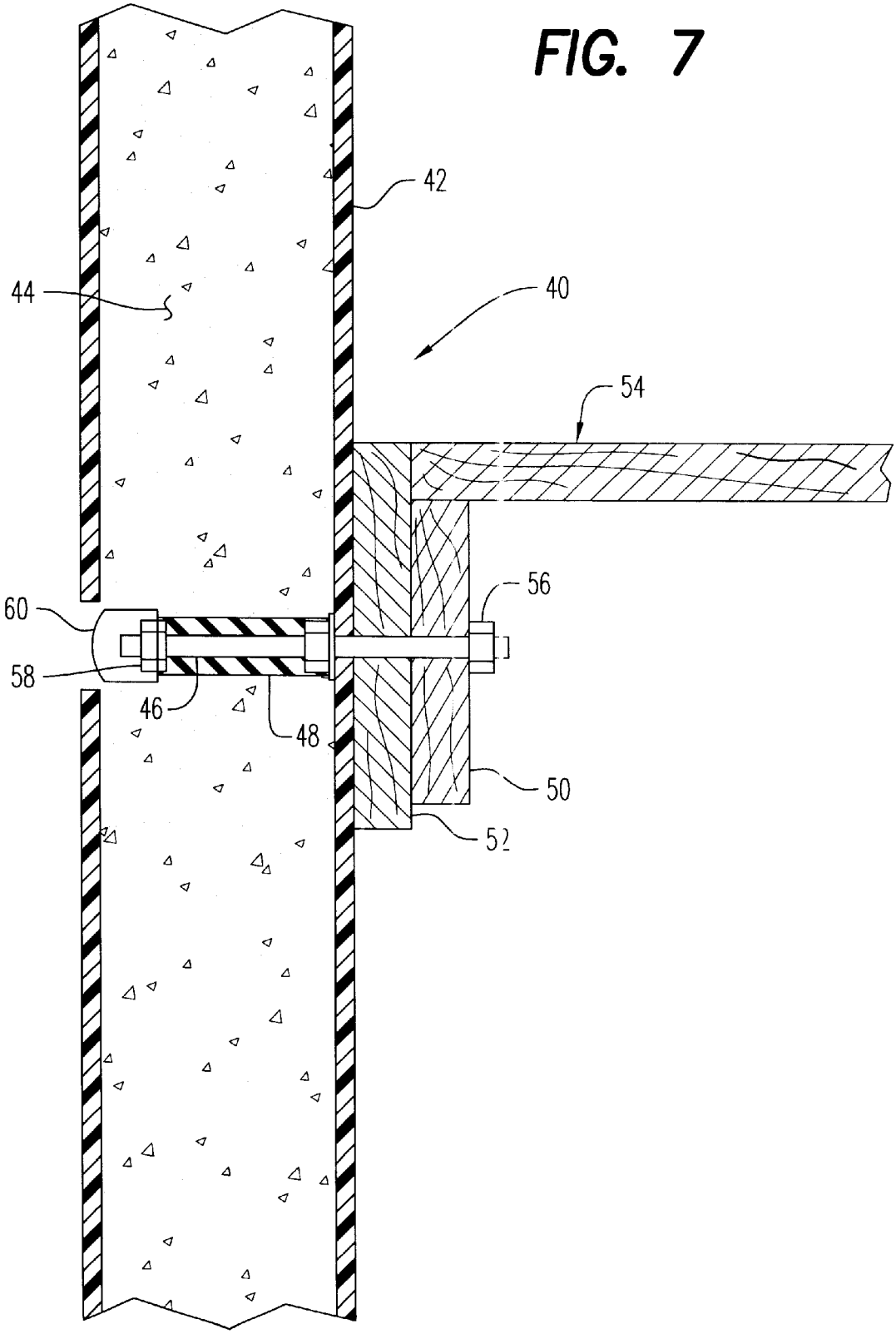
FIG. 7 is an enlarged section view of a portion of an alternate embodiment of an upright tubular piling filled with concrete and demonstrating one means for attachment to a dock.

Referring to FIG. 7, one embodiment of a connecting means between a portion of a concrete-filled piling 42 to a dock arrangement 54 is there shown. The tubular member 42 is filled with cured concrete 44. A pvc sleeve 48 is either cast embedded with the uncured concrete 44 or positioned into a suitable hole drilled for its receipt after the concrete 44 is cured. An elongated bolt 46 with its head 58 against one end of the pvc sleeve 48 extends outwardly through the opposite side of the tubular member 42 as shown for clamping threaded engagement into dock stringers 50 and 52 and secured there by nut 56. A protective cap 60 is held in place over the head 58 for environmental protection.

Figure 8:
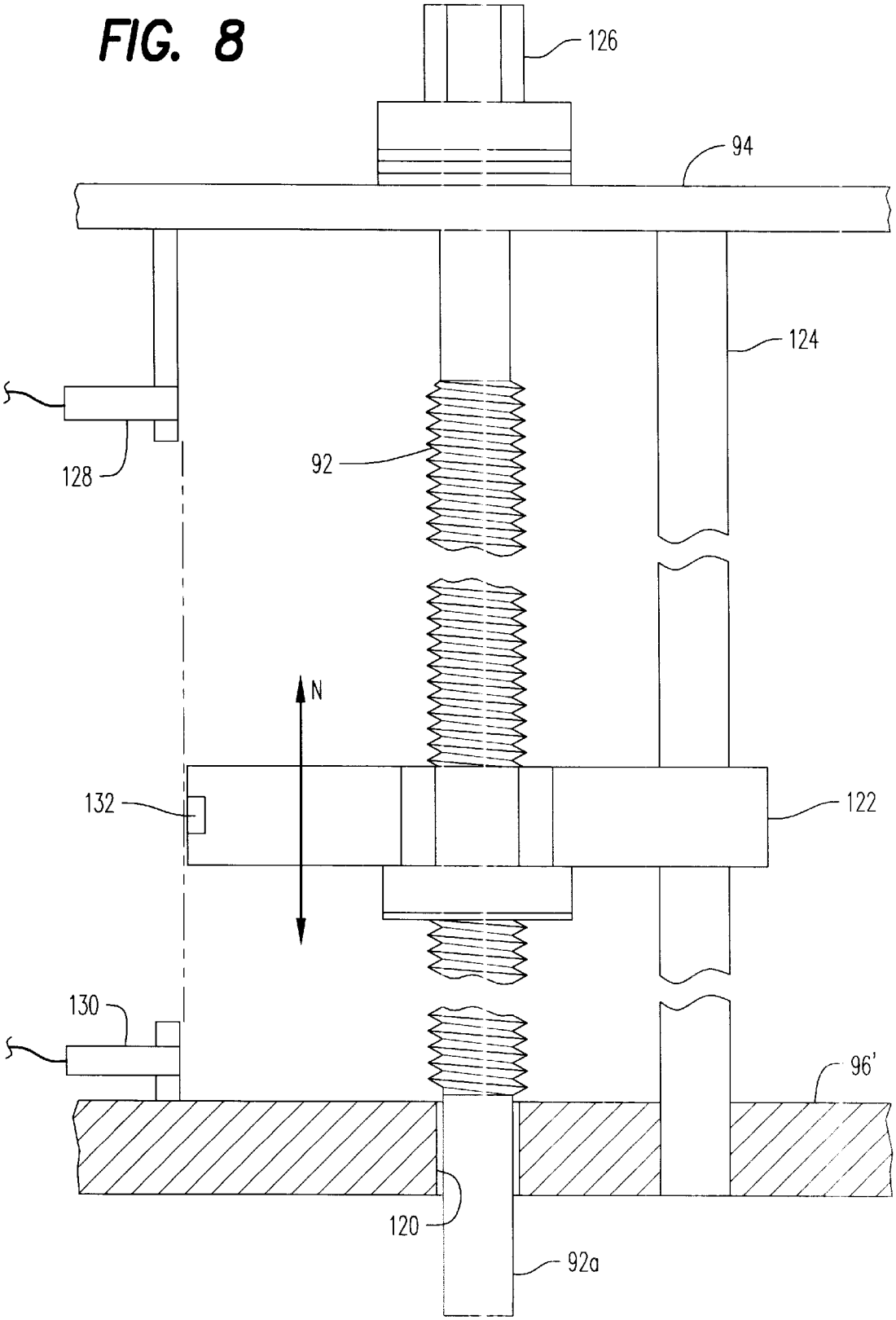
FIG. 8 is a side elevation schematic view of the preferred output drive shaft arrangement which supports and vertically positions a boat lift cradle.

Referring now to FIG. 8, the preferred embodiment of the drive shaft and moveable plate arrangement is there shown and is held in position within the hollow upper portion of a tubular piling member 80 or 80' (not shown for clarity) as previously described. The upper plate 94 fixed within the tubular member (not shown) supports a hex drive end 126 of the ACME screw drive shaft 92. This hex drive 126 operably engages into the drive train arrangement 102 of FIGS. 4 and 7 (not shown) previously described. The lower unthreaded end 92*a* of the drive shaft 92 is supported within a mating aperture 120 or, preferably a bearing (not shown) of the lower fixed support plate 96'. As the drive shaft 92 rotates in either direction, vertical movement of the moveable plate 122 in the direction of arrow N is effected. A guide bar 124 which extends between the motor mount plate 94 and the lower support plate 96' prevents rotation of the moveable plate 122.

A magnet 132 is embedded within the end of the moveable plate 122 in vertical alignment with magnetic switches 128 and 130. Thus, when the moveable plate 122 is moved to its upper or lower position limits, the corresponding REED switch 128 or 130, respectively, interrupt power to the drive motor stopping further movement of the moveable plate 122.

Figure 9:
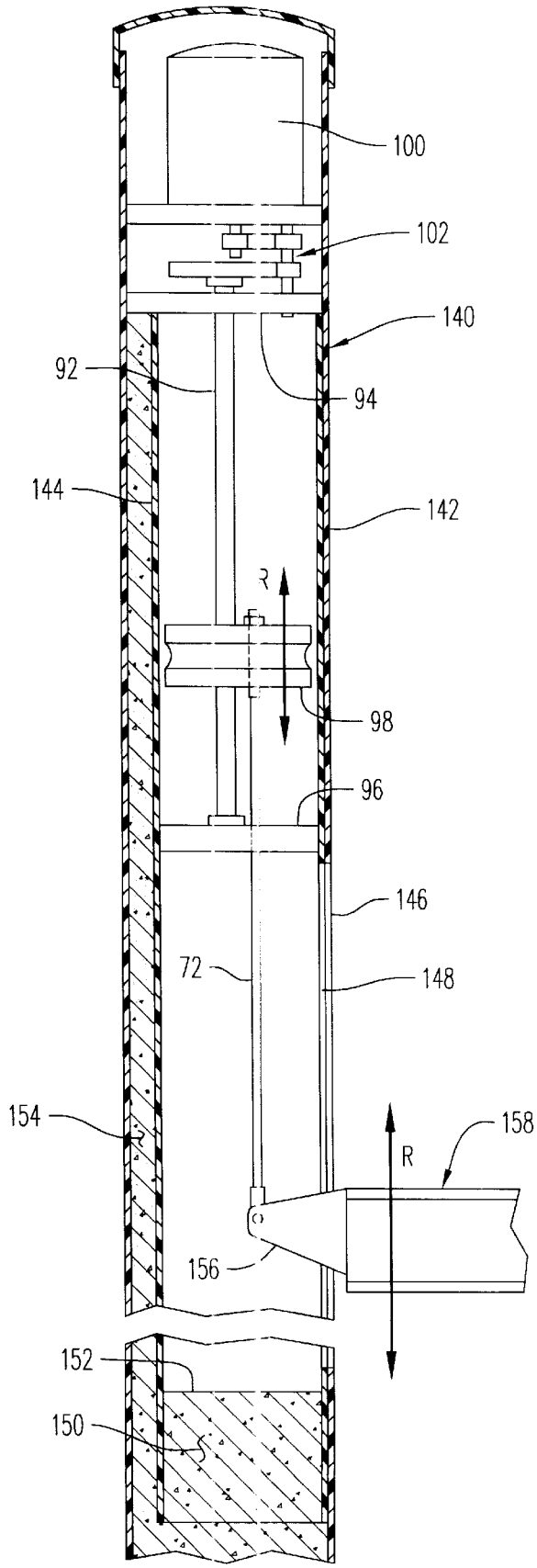
FIG. 9 is a side elevation section view of the preferred embodiment of the piling structure of the invention.

Referring lastly to FIG. 9, the preferred embodiment of the piling apparatus is shown generally at numeral 140. This embodiment 140 includes a drive motor, gear reduction arrangement 102 and a threaded rotational output shaft 92 downwardly extending as previously described which, when operated by motor 100, serve to move the boat lift 158 in the direction of arrow R. However, in this embodiment 140, an inner tubular member 144, also made of pvc plastic conduit, is secured within the outer tubular member 142 in a non-concentric fashion. The inner tubular member 144 extends from the motor support plate 94 at its upper end downwardly and is cast and secured into concrete 150 at its lower end before the concrete is cured. The inner tubular member 144 is secured in an offset or non-concentric position with longitudinally extending slots 146 and 148 are aligned and coextending against one another along each of the inner and outer tubular members 144 and 142, respectively. Again, this upright slot 146/148 provides clearance and smooth vertical movement for an outer blade 156 of the boat cradle 158, each outer blade 156 being supported by cable 72.

The eccentrically shaped cavity between the inner and outer tubular members 144 and 146 is also filled with cured concrete 154 for added strength and stability over the entire length of the inner tubular member 144. A sleeve may be temporarily sealingly secured around the central portion of the outer piling 142 to prevent uncured concrete from leaking out of the slots 146/148.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A tubular piling driving apparatus for securing an upright tubular piling into the bottom of a body of water comprising:

an elongated pressurized fluid actuator having a longitudinally extending shaft extending from an upper end thereof;

said actuator including a first inlet for receiving pressurized fluid which causes said shaft to extend longitudinally from said actuator to a first position and a second inlet for receiving pressurized fluid which causes said shaft to withdraw longitudinally into said actuator to a second position;

a collar sized for supportively fitting over an upper end of the tubular piling, said collar having a central support for supportively receiving said actuator substantially in longitudinal alignment within the piling;

a weight support connected to a distal end of said shaft and a weight supportable atop said weight support;

said weight alternately positioned above said collar when said shaft is in said first position and against said collar when in said second position whereby, when pressurized fluid is transferred from said first inlet to said second inlet, said weight impacts downwardly against said collar to drive the piling into the bottom.

2. A method of securing a tubular hollow piling into a bottom of a body of water, the bottom being formed of substrate material, comprising the steps of:

A. positioning the tubular hollow piling open at each end thereof into an upright orientation with a lower end thereof resting against the bottom;

B. positioning a tubular piling driving apparatus atop said tubular piling, said apparatus comprising:

an elongated pressurized fluid actuator having a longitudinally extending shaft extending from an upper end thereof;

said actuator including a first inlet for receiving pressurized fluid which causes said shaft to extend longitudinally from said actuator to a first position and a second inlet for receiving pressurized fluid which causes said shaft to withdraw longitudinally into said actuator to a second position;

a collar sized for supportively fitting over the open upper end of said piling, said collar having a central support for supportively receiving said actuator substantially in longitudinal alignment with said piling;

a weight alternately positioned above said collar when said shaft is in said first position and against said collar when in said second position;

C. embedding the lower portion of said tubular piling into the bottom by operating said apparatus whereby, transferred pressurized fluid from said first inlet to said second inlet causes said weight to impact downwardly against said collar to drive the piling into the bottom.

* * * * *